United States Patent [19]

Cushing

[11] Patent Number: 4,807,309

[45] Date of Patent: Feb. 28, 1989

[54] SWIMMING POOL PROTECTOR AND CONVERTER

[76] Inventor: R. Rand Cushing, 696 Commercial St., Weymouth, Mass. 02189

[21] Appl. No.: 126,610

[22] Filed: Nov. 30, 1987

[51] Int. Cl.[4] ..... E04H 3/18

[52] U.S. Cl. ..... 4/494

[58] Field of Search ..... 4/494–496, 4/498, 503, 504, 506, 513; 272/3

[56] References Cited

U.S. PATENT DOCUMENTS

| | | | |
|---|---|---|---|
| 1,464,804 | 8/1923 | Booraem | 4/494 |
| 1,918,437 | 7/1933 | Torrance | 4/494 X |
| 2,766,046 | 10/1956 | Skrainka | 4/494 X |
| 3,639,921 | 2/1972 | Siler | 4/494 |
| 3,797,049 | 3/1974 | De Santo | 4/506 X |

FOREIGN PATENT DOCUMENTS

| | | | |
|---|---|---|---|
| 619263 | 9/1935 | Fed. Rep. of Germany | 4/495 |

*Primary Examiner*—Charles E. Phillips

*Attorney, Agent, or Firm*—M. Lawrence Oliverio

[57] ABSTRACT

An apparatus for converting a swimming pool into a skating rink and preserving the structural integrity of the pool, the pool comprising a water basin and a ledge extending around the top edge of the basin, the ledge protruding inwardly over the edge of the basin, the basin being filled with water up to a predetermined level below the ledge, the apparatus comprising a sheet completely overlying the ledge and the open top of the basin and extending downwardly into the basin to at least the predetermined level of the water in the basin such that the bottom of the sheet contacts essentially the entire surface of the water in the basin below and inside the ledge; the sheet extending downwardly into the basin and being filled above its top surface with water up to a predetermined level below the ledge; a plurality of impact resistant cornices overlying the sheet and the ledge and extending around the circumference of the pool in sequential array; each cornice comprising a trapezoidal plate overlying the ledge and a rectangular flange plate attached to and extending the length of the short end of the trapezoidal plate, the flange plate extending downwardly into the basin a predetermined level below the ledge; the trapezoidal sides of the trapezoidal plate forming an angle of greater than about 45 degrees with a line extending from the short end of the plate; the cornices being sequentially arranged around the ledge such that the left side of the rectangular plate of each cornice is aligned substantially parallel to and closely adjacent to the right side of the rectangular plate of each immediately adjacent cornice.

9 Claims, 2 Drawing Sheets

SWIMMING POOL PROTECTOR AND CONVERTER

BACKGROUND OF THE INVENTION

The present invention relates to apparati for converting swimming pools of essentially any size and shape into a skating rink in winter weather and preserving and protecting the structural integrity of the pool.

SUMMARY OF THE INVENTION

In accordance with the invention there is provided an apparatus for converting a swimming pool into a skating rink and preserving the structural integrity of the pool, the pool comprising a water basin and a ledge extending around the top edge of the basin, the ledge protruding inwardly over the edge of the basin, the basin being filled with water up to a predetermined level below the ledge, the apparatus comprising a sheet completely overlying the ledge and the open top of the basin and extending downwardly into the basin to at least the predetermined level of the water in the basin such that the bottom of the sheet contacts essentially the entire surface of the water in the basin below and inside the ledge; the sheet extending downwardly into the basin and being filled above its top surface with water up to a predetermined level below the ledge; a plurality of impact resistant cornices overlying the sheet and the ledge and extending around the circumference of the pool in sequential array; each cornice comprising a trapezoidal plate overlying the ledge and a rectangular flange plate attached to and extending the length of the short end of the trapezoidal plate, the flange plate extending downwardly into the basin a predetermined level below the ledge; the trapezoidal sides of the trapezoidal plate forming an angle of greater than about 45 degrees with a line extending from the short end of the plate; the cornices being sequentially arranged around the ledge such that the left side of the rectangular plate of each cornice is aligned substantially parallel to and closely adjacent to the right side of the rectangular plate of each immediately adjacent cornice.

Preferably one of the left or the right sides of each trapezoidal plate overlaps the other of the left or right sides of an immediately adjacent trapezoidal plate. Most preferably the left and right sides of immediately adjacent rectangular plates are rotatably connected. The trapezoidal plate and rectangular plate of each cornice are typically integrally formed together as a unitary structure.

The rectangular flange plates typically extend downwardly over the ledge into the basin to a level below the predetermined level of water residing on the top surface of the sheet. The length of the short ends of the trapezoidal plates is preferably selected to be between about one and about four feet, the height of the trapezoidal plates is selected to be between about 20 inches and about 42 inches and the predetermined angles of the trapezoidal sides is selected to be between about 55 and about 80 degrees with a line extending from the short end of the plate.

The thickness of the trapezoidal plates may be tapered from the sides toward the middle of the rearward end thereof; or the thickness of the trapezoidal plates may alternatively be uniform throughout such that the bottom surfaces thereof are substantially flat.

One of the right or left sides of the rectangular plates may include pin means and the other of the right or left sides of the rectangular plates may include complementary aperture means for rotatably receiving the pin means.

DETAILED DESCRIPTION OF THE INVENTION

Following is a description of a preferred embodiment(s) of the invention.

Figure 4:
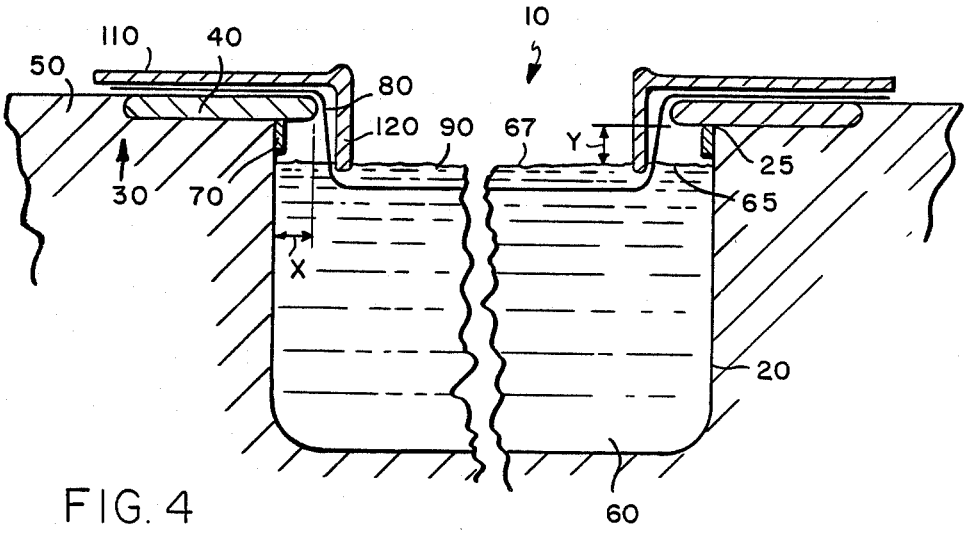
FIG. 4 is a side-cross sectional view of a swimming pool showing the relative positioning of cornice and cover sheet elements, the cover sheet overlying the ledge of the basin of the pool and extending downwardly into the water in the basin and the cornices overlying the cover sheet and the ledge of the pool.
Figure 5:
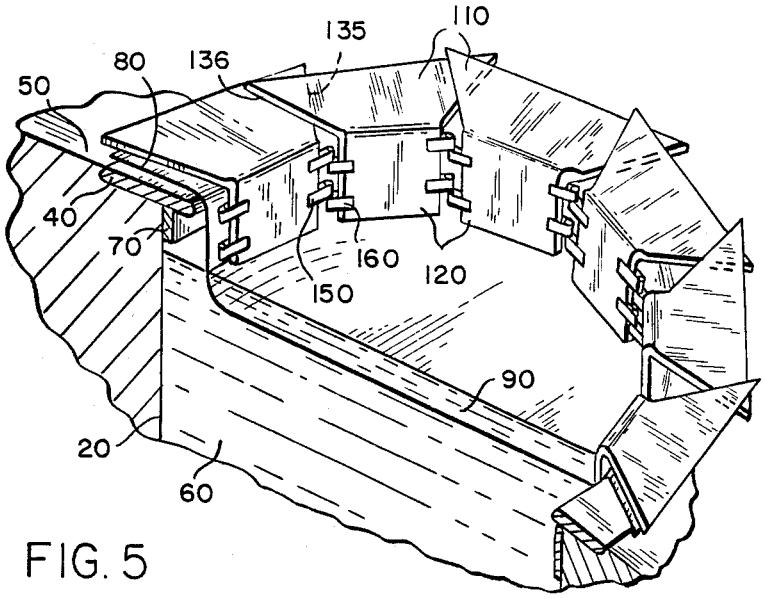
FIG. 5 is an isometric view of a portion of a swimming pool showing the successive arrangement of several cornices around a portion of the ledge of the pool.

There is shown in FIGS. 4, 5, a swimming pool 10 comprising a basin 20 having a ledge 30 around the top rim 25 thereof. The ledge 30 typically comprises a relatively short coping portion 40 and a rearward flat walking surface 50 abutting the rear end of coping 40. The coping portion 40 protrudes laterally over the top edge or rim 25 of the basin a relatively short distance X, typically between about 2 and about 12 inches.

In preparation of the pool 10 for use as a skating rink the supply of water 60 therein is typically maintained such that the top levels 65, 67 of the water 60 and 90 are maintained a relatively short distance Y below the ledge 30 such that an ice skater may conveniently step down from above ledge 30 onto the skating surface 67. The distance Y is typically selected to be great enough to allow surfaces 65 and 67 to reside below the bottom of a tile edging 70 which is typically provided around the top edge of a pool 10 such that when the water 60 freezes the tile 70 is not damaged by the freezing water 60. Y is typically selected to be between about 6 and about 24 inches.

As shown in FIG. 4 a cover sheet 80 completely overlies the ledging 30, i.e. over the coping 40 and typically further over at least about a 4 inch length of walking surface 50, and further substantially completely overlies the portion of surface 65 which lies below and between the inner edge of coping 40. As shown, the sheet 80 extends downwardly into basin 20 over surface 65. In converting the pool 10 into a skating rink, a pool of water 90 is provided on the top surface of sheet 80, preferably prior to the time when the main body of water 60 freezes. As shown in FIG. 4 when pool of water 90 is placed over sheet 80, the level 65 of water 60 will rise to coincide with the level 67 of pool of water 90. Thus when pool of water 90 is provided before the main body of water 60 has frozen, a continuous top level 65, 67 of water is established within basin 20. In any event, the top level 67 of pool 90 is preferably maintained at a level such that level 67 resides below the bottom surface of coping 40 such that a skater may conveniently step down from above coping 40 onto the surface 67, typically between about 6 and about 24 inches below coping 40.

The sheet 80 typically comprises a water impervious plastic, canvas or similar material which is capable of preventing debris such as dirt, leaves and the like from passing therethrough into the main body of water 60. When the sheet 80 is selected to comprise a water impervious material, the sheet serves to define and separate the pool 90 of skating rink water from the main body 60 of basin 20 water. The sheet 80 is preferably relatively thin, e.g. between about 0.01 and about 0.6 inches, yet tough and tear resistant such that when subjected to the pressure of an ice skate blade the sheet 80 resists immediate tearing thereby minimizing or eliminating the possibility of an immediate puncture by a skater s skate and thus effecting a softening and slowing of an accidental fall through a thinly iced surface 67 into the main body of pool water 60. The sheet 80 may alternatively comprise a mesh material such as a fabric or screen which allows water to pass through the sheet 80 but not debris As shown in part in FIG. 5 a successive or consecutive array of cornices 100 are arranged around the ledging 30 of the pool 10. Such cornices 100 are preferably placed around the entire circumference of the pool as described more fully hereinafter.

Figure 1:
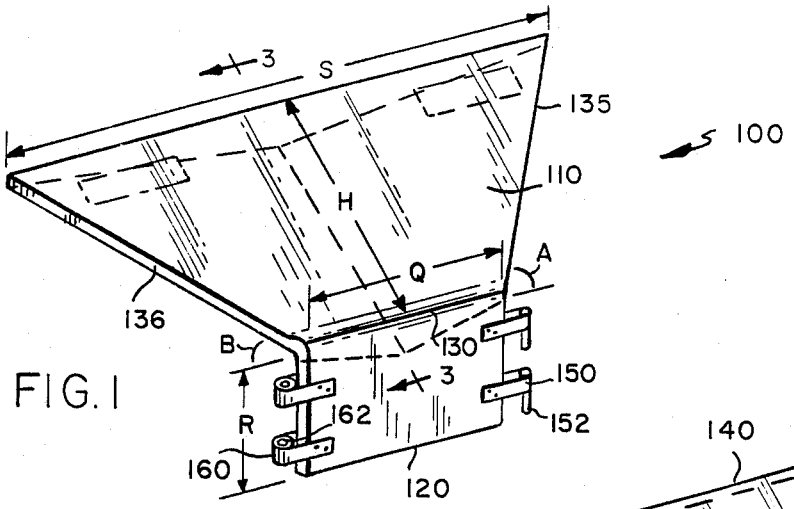
FIG. 1 is a an isometric view of a cornice element according to the invention having a trapezoidal support plate tapered in thickness from the side to the middle.
Figure 2:
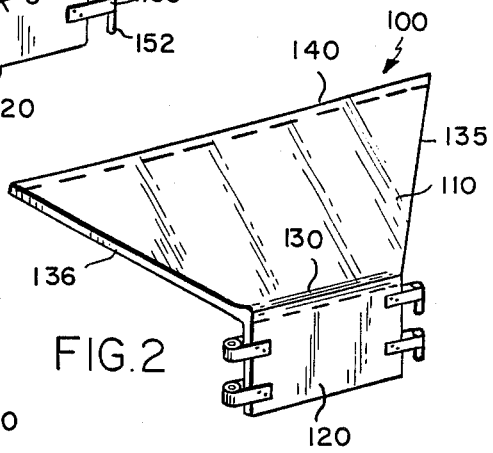
FIG. 2 is an isometric view of an alternative cornice element according to the invention having a trapezoidal support plate of uniform thickness.

With reference to FIGS. 1–4 each cornice 100 comprises a rearward trapezoidal plate 110 and a forward rectangular flange plate 120. As shown in FIGS. 1, 2 the plate 110 has a trapezoidal shape having a short end 130 of length Q and a long end 140 of length S. The short end 130 typically defines a common side with rectangular plate 120 having a common width Q. Most preferably plates 110, 120 are integrally formed together as unitary structure 100. Such a unitary structure 100 typically comprises a tough, puncture resistant, dimensionally stable material such as an impact resistant fiberglass, plastic, wood, metal or similar impact resistant material, or a combination of two or more of the foregoing materials.

With reference to FIG. 1 the trapezoidal plate 110 has two trapezoidal sides 135, 136 which form angles A and B respectively with the line extending from and coincident with the front end 130. Angles A and B are preferably selected to be between about 55 and about 80 degrees. Most preferably trapezoidal plate 120 is symmetrical, i.e. angles A and B are substantially equal and short end 130 and long end 140 are substantially parallel to each other.

As shown in FIGS. 1, 4 in cross-section, the cornices 100 are positioned on top of the structure of the pool 10 such that the trapezoidal plates 110 overlie the ledge 30 and the portions of the sheet 80 which overlie the ledge 30. The height, H, and the thickness of the trapezoidal plates 110 is typically selected to be long enough to insure that the sheet 80 is secured against moving or sliding on top of ledge 30 by the frictional weight pressure of plate 110. The sheet 80 is preferably selected to be of such a size as to extend beyond and behind the rear ends of coping portion 40 as shown in FIGS. 4, 5.

Plates 120, FIGS. 1–4, overlie the forward edges of coping 40 and the portions of sheet 80 which extend downwardly between the edge of coping 40 and the point of first contact of sheet 80 with surface 65 of water 60. In a most preferred embodiment, the length, R, of plate 120 is selected to be so long as to extend downwardly into pool of water 90 below surfaces 65, 67. The precise length selected for R will vary and depend upon the height selected for level 67. As described above in a preferred embodiment where level 67 is selected to be between about 6 and about 24 inches below coping 40, the length R is preferably selected to be between about 8 and about 26 inches. As can be seen from FIG. 4 plate 120 effectively covers sheet 80 and tile edging 70 from contact from above the skating surface 67.

Figure 6:
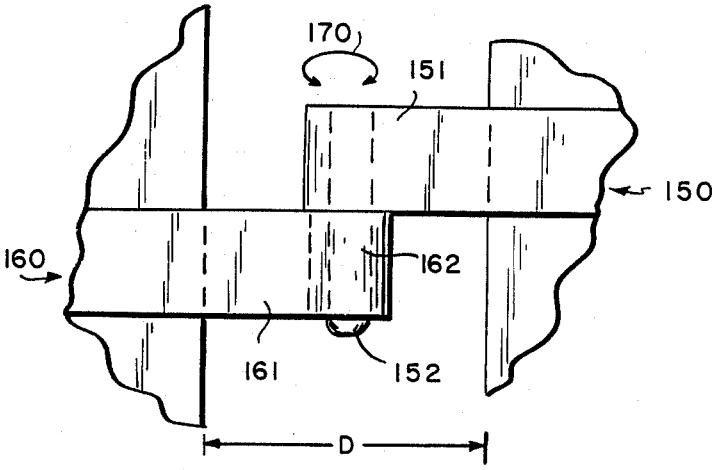
FIG. 6 is a partial side cross-sectional view of pin and aperture mechanisms for rotatably connecting cornice elements of the invention; and, FIG. 7 is a top cross-sectional view of the left and right edges of rectangular flange plates of a pair of adjoined cornice elements according to an alternative rotatable adjoinment mechanism.

In one embodiment of the invention as shown in FIGS. 1, 5 one side of the rectangular plates 120 are provided with pin mechanisms 150 and the other side of the plates 120 with complementary aperture mechanisms 160. As shown in FIG. 5, the cornices 100 are arranged around the ledging 30 of the pool 10 such that the left and right sides of adjacent rectangular plates 120 of adjacent cornices 100 are aligned substantially parallel to each other. As shown in FIGS. 5, 6 the pin mechanisms 152 on one side of the plates 120 are inserted into the aperture or pin receiving mechanism 162 provided on the other side of an immediately adjacent plate 120 such that the adjoined plates 120 are rotatable relative to each other by virtue of the pins 150, 152, being rotatable within the apertures 160, 162. Such rotatable adjoinment of plates 120 allows successively adjoined cornices 100 to be readily adjoined and simultaneously positioned on top of the ledging 30 as shown in FIG. 4 regardless of the contour or curving of the edge of coping 40 around the circumference of the pool 10 Such rotatable adjoinment also allows essentially all cornices 100 to be manufactured to a uniform size and all uniformly sized cornices to be readily positioned s shown in FIG. 4 around the entire circumference of essentially any shaped pool.

As shown in FIGS. 5, 6, successive cornices 100 are arranged around and on top of ledge 30 such that the left and right sides of adjacent plates 120 of adjacent cornices 100 are relatively closely spaced together, i.e., less than a maximum distance D of about 3 inches apart, thus obstructing an ice skate or other object from coming into contact with the sheet 80 which is behind the plates 120. As can also be seen from FIG. 5, the trapezoidal sides 135, 136 of adjacently arranged cornices 100 overlap each other, even around the most severe curvature portions of the circumference of the pool 10; such continuous overlapping of successive trapezoidal plates 110 thus effectively covers the entire upper ledge surface and the underlying sheet 80 and protects those elements from puncture, tear or other physical abuse by a skater using the pool 10 as a skating rink.

As shown in FIG. 5 the right side 135 of each trapezoidal plate 110 underlies the left side 136 of an adjacent plate 110. Such consecutive overlapping of a left side 135 over a right side 136 (or vice versa) is a most preferred embodiment of the apparatus of the invention in that any possibility of the left 135 and right 136 sides of a pair of plates 110 one removed from each other, interfering or abutting each other is eliminated. The curvature of the portion of the circumference of the pool shown in FIG. 5 is "inwardly" curved and, as shown, uniformly sized trapezoidal plates 110 can effectively cover and overlie essentially the entirety of the sheet 80 and ledge 30 thereunder, thus protecting the sheet 80 and ledge 30 from puncture or other damage. As can be readily imagined, where a portion of the curvature of the circumference of the pool may be straight or "outwardly" curved, successive arrangement of cornices 100 therealong will effect the same sort of complete trapezoidal plate 110 protection of underlying sheet 80 and ledge 30. Insofar as a right angle may exist at some point around the circumference of a pool, e.g. in a rectangular or square shaped, pool, a preferred arrangement of cornices 100 therearound would preferably be effected by placing one cornice 100 over the right angle portion of the pool such that the short end 130 and flange plate 120 of a cornice 100 forms a hypotenuse with the sides of pool which mate to form the right angle in the pool circumference.

As mentioned above, each one of the plurality of cornices 100 is preferably of a uniform size, i.e. each cornice 100 preferably has a uniform height H, long and trapezoidal end length S, short end length Q, flange plate length R, right side angle A and left side angle B. Most preferably where a uniform cornice 100 size is utilized, the height H is selected to be between about 20 and about 42 inches, length S is selected to be between about four and about six feet, length Q is selected to be between about two and about four feet, length R is selected to be between about 8 and about 26 inches and angles A and B are selected to be between about 55 and about 80 degrees. The preferred thickness of plate 110 will depend to a certain extent upon the selection of the height H, lengths Q and S and angles A and B, the primary considerations in selection of the thickness of plate 110 being that the plate 110 possess sufficient weight enough to remain relatively stationary upon placement over ledge 30 and sheet 80 and sufficient thickness to resist puncture or breakage. Where the plates 110 comprise a high impact resistant fiberglass, plastic or other material and the preferred range of lengths Q, R, S, H, and angles A and B are selected, the thickness of plate 110 is typically selected to be in the range of between about 0.125 and about 0.75 inches.

Figure 3:
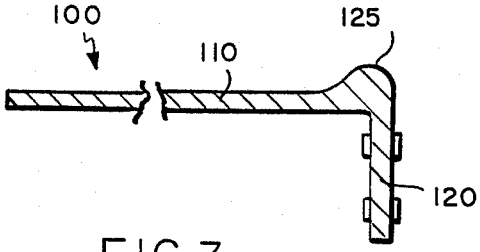
FIG. 3 is a side cross-sectional view of the cornice element of FIG. 1 taken along the center thereof.

As best shown in FIG. 3, the short end 130 preferably includes a lip 125 which protrudes upwardly slightly from the otherwise flat top contour of plate 110. The lip 125 is provided for purposes of allowing a person to manually grab onto the lip 125 and pull himself up over lip 125 and onto plate 110, e.g. in the event a skater falls through a thinly iced surface 67; and lip 125 also serves to cause rain and dirt and the like to wash away from the pool.

As shown in FIG. 5 the bottom edges of plates 120 are preferably aligned with each other such that they all lie in a common horizontal plane. In view of the preferred successive overlapping of a left trapezoidal side 136 with a right trapezoidal side 135 (or vice versa), rectangular plates 120 may become slightly skewed such that the bottom edges of plates 120 are not precisely aligned so as to precisely be in a common horizontal plane. In order to impart the most desirable appearance to the apparatus, the left (or right) sides of plates 120 may be constructed to be slightly longer than the right (or left) sides of plates 120, e.g. by between about 0.1 to about 0.8 inches depending on the selected thickness of plates 110, in order to insure that the bottom edges of plates 120 are more precisely aligned so as to be in a common horizontal plane.

As shown in FIG. 1, the trapezoidal plates 110 may be tapered in width from the sides 135, 136 toward the middle of the plate 110 for purposes of more readily enabling the sequential overlapping and underlying of sides 135, 136 between adjacent cornices 100. As shown by the dashed lines in FIG. 1 the tapering of plate 110 is preferably limited to the rearward portion of the plate 110 while the forward portion toward short end 130 is preferably substantially uniform in thickness from side 135 to side 136 such that when cornices 100 are arranged in sequential overlapping, underlying relationship as described above with reference to FIG. 5, the forward portions of plates 110 lie substantially flat upon underlying sheet 80 and ledge 30. Also as shown in FIG. 2 by the dashed lines, the thickness of the plate 110 may alternatively be uniform throughout such that the bottom surface of plate 110 is flat, such an embodiment being preferred for purposes of ease of manufacture.

FIGS. 1, 6 illustrate an embodiment where pin mechanisms 150 and pin receiving mechanisms 160 are employed for adjoining or connecting the left and right sides of adjacent plates 120. As shown in FIGS. 1, 6 the pin mechanism 150 and pin receiving mechanism 160 are attached by conventional means (not shown) to adjacent rectangular plates 120 by arms 151 and 161 respectively. Arms 151, 161 extend laterally from the sides of plates 120 a relatively short distance such that when pins 152 are inserted into apertures 162, the plates 120 are spaced a maximum distance, D, of between about 1 and about 4 inches apart. Pin 152 extends downwardly from arm 151 and is inserted into a complementary aperture 162 provided on the end of arm 161 in order to rotatably connect plates 120. As shown arms 151, 161 are appropriately attached to the sides of plates 120 such that when pins 152 are inserted within apertures 162, the sides of adjacent plates 120 are substantially parallel and short ends 130 of plates 110 lie in about the same plane.

Figure 7:
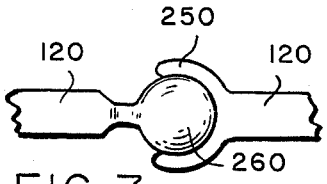

The sides of plates 120 may be rotatably connected in a variety of manners such that the sides are maintained substantially parallel to each other. An alternative means of rotatably connecting, adjoining the sides of plates 120 is shown in cross-section in FIG. 7 wherein one side of one plate 120 is provided with a C-shaped arm 250 such that an aperture is provided therein and the other side of an adjacent plate is provided with a complementary cylindrically shaped pin 260. Pin 260 and C-shaped arm 250 typically extend less than the full length R of opposing sides of plates 120 such that water in pool 90 may penetrate behind plates 120; pin 260 and arm 250 are preferably integrally attached to the ledges of plates 120 such as in the form of unitary structures. The diameter of the inner curved surface of arm 250 is typically approximately equal to the diameter of pin 260 and the arm 250 extends around more than about half the circumference of pin 260 such that pin 260 is rotatably held within the inner curved surface of arm 250 The plates 120, FIG. 7, are initially connected by inserting pin 260 into the inner curved surface of arm 250 from above plate 110 in the manner of inserting a pin into a cylindrical aperture. Such an alternative rotatable adjoinment eliminates any open spacing between plates 120 and thus completely protects sheet 80 residing behind plates 120.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. Apparatus for converting a swimming pool into a skating rink and preserving the structural integrity of the pool, the pool comprising a water basin and a ledge extending around the top edge of the basin, the ledge protruding inwardly over the edge of the basin, the basin being filled with water up to a predetermined level below the ledge, the apparatus comprising:

a sheet completely overlying the ledge and the open top of the basin and extending downwardly into the basin to at least the predetermined level of the water in the basin such that the bottom of the sheet contacts essentially the entire surface of the water in the basin below and inside the ledge;

the sheet extending downwardly into the basin and being filled above its top surface with water up to a predetermined level below the ledge;

a plurality of impact resistant cornices overlying the sheet and the ledge and extending around the circumference of the pool in sequential array;

each cornice comprising a trapezoidal plate overlying the ledge and a rectangular flange plate attached to and extending the length of the short end of the trapezoidal plate, the flange plate extending downwardly into the basin a predetermined level below the ledge;

the trapezoidal sides of the trapezoidal plate forming an angle of greater than about 45 degrees with a line extending from the short end of the plate;

the cornices being sequentially arranged around the ledge such that the left side of the rectangular plate of each cornice is aligned substantially parallel to and closely adjacent to the right side of the rectangular plate of each immediately adjacent cornice.

2. The apparatus of claim 1 wherein one of the left or the right sides of each trapezoidal plate overlaps the other of the left or right sides of an immediately adjacent trapezoidal plate.

3. The apparatus of claim 2 wherein the left and right sides of immediately adjacent rectangular plates are rotatably connected.

4. The apparatus of claim 3 wherein the trapezoidal plate and rectangular plate of each cornice are integrally formed together as a unitary structure.

5. The apparatus of claim 1 wherein the rectangular flange plates extend downwardly over the ledge into the basin to a level below the predetermined level of water residing on the top surface of the sheet.

6. The apparatus of claim 1 wherein the length of the short ends of the trapezoidal plates is selected to be between about one and about four feet, the height of the trapezoidal plates is selected to be between about 20 inches and about 42 inches and the predetermined angles of the trapezoidal sides is selected to be between about 55 and about 80 degrees with a line extending from the short end of the plate.

7. The apparatus of claim 1 wherein the thickness of the trapezoidal plates is tapered from the sides toward the middle of the rearward end thereof.

8. The apparatus of claim 1 wherein one of the right or left sides of the rectangular plates include pin means and the other of the right or left sides of the rectangular plates include complementary aperture means for rotatably receiving the pin means.

9. The apparatus of claim 1 wherein the thickness of the trapezoidal plates is uniform throughout such that the bottom surfaces thereof are substantially flat.

* * * * *